United States Patent [19]

Held

[11] Patent Number: 4,737,749

[45] Date of Patent: Apr. 12, 1988

[54] ELECTROMAGNETIC SWITCHGEAR

[75] Inventor: Kurt Held, Amberg, Fed. Rep. of Germany

[73] Assignee: Siemens Aktiengesellschaft, Munich, Fed. Rep. of Germany

[21] Appl. No.: 924,699

[22] Filed: Oct. 29, 1986

[30] Foreign Application Priority Data

Nov. 14, 1985 [DE] Fed. Rep. of Germany ..... 3540460

[51] Int. Cl.[4] ..... H01H 67/02

[52] U.S. Cl. ..... 335/131; 335/133; 335/127

[58] Field of Search ..... 335/125, 126, 127, 128, 335/129, 130, 131, 132, 133, 134, 135

[56] References Cited

U.S. PATENT DOCUMENTS

| | | | |
|---|---|---|---|
| 2,833,885 | 5/1958 | Wells | 335/129 |
| 3,215,800 | 11/1965 | Hurter | 335/131 |
| 3,334,319 | 8/1967 | Herrmann | 335/132 |

*Primary Examiner*—E. A. Goldberg
*Assistant Examiner*—Lincoln Donovan
*Attorney, Agent, or Firm*—Kenyon & Kenyon

[57] ABSTRACT

An electromagnetic switchgear having movable contact members engagable with respective fixed contact members includes an elastic connection between a movable armature and a contact carrier. The elastic connection enables relative motion between the armature and the contact carrier so that the contact carrier may remain relatively stationary during continued motion of the armature. The elastic connection comprises an appropriately designed coupling spring.

11 Claims, 1 Drawing Sheet

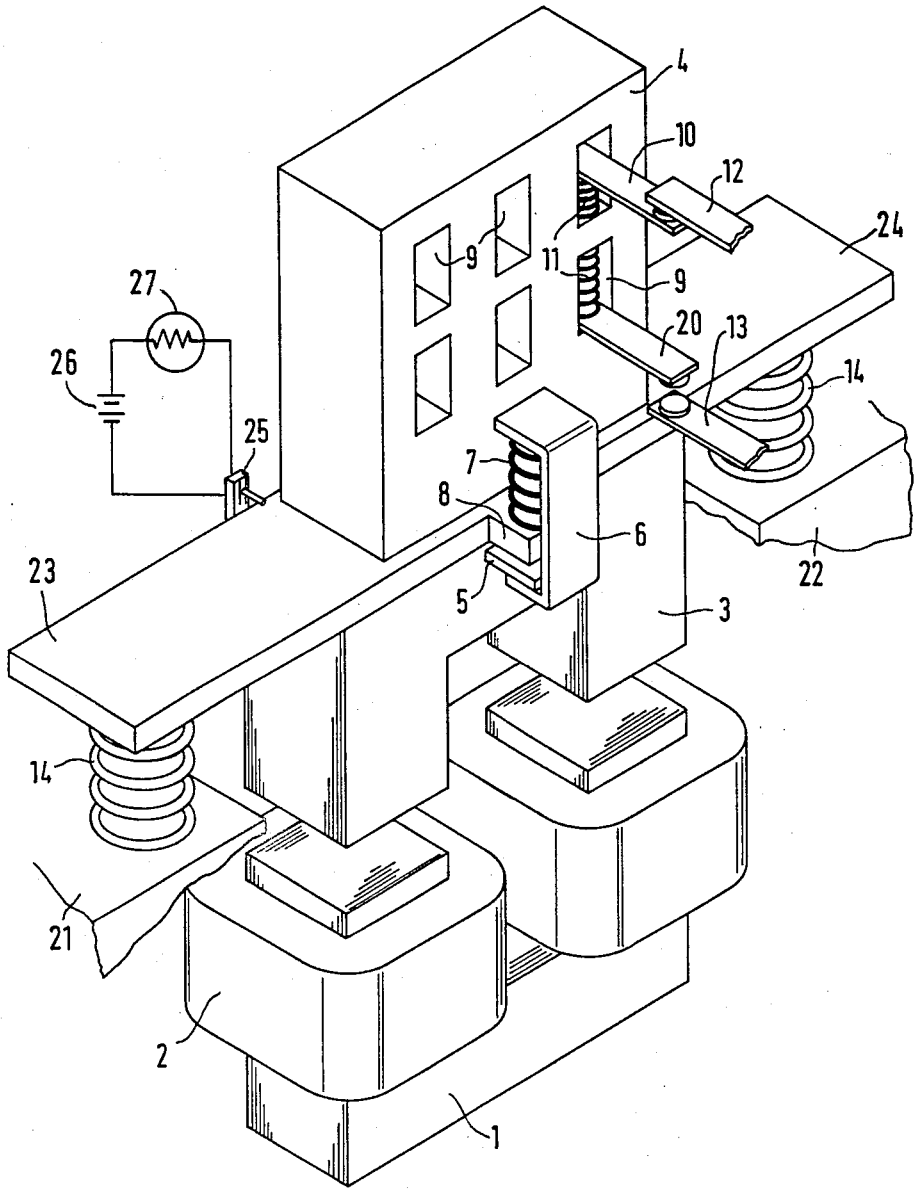
4
10
12
24
9
11
9
27
20
13
26
14
25
7
8
6
22
23
5
3
14
21
2
1

ELECTROMAGNETIC SWITCHGEAR

BACKGROUND OF THE INVENTION

This invention relates to electromagnetic switchgear. More particularly, this invention relates to electromagnetic switchgear having movable contacts mounted to a shiftable contact carrier for alternatingly engaging and disengaging respective stationary contacts.

As described in U.S. Pat. No. 3,334,319 to Herrmann, an electromagnetic switchgear includes contacts which are arranged so that the breaking of an engagement between a pair of contacts and the formation of an engagement between another pair of contacts do not occur simultaneously. Between the opening of one connection and the closing of an associated connection, the contact bridge carrier must traverse a preestablished distance. If, however, the first pair of contacts are welded to one another, one of the corresponding contact bridges may be deformed during motion of the contact bridge carrier with the possible result that the opening connection and the closing connection occur simultaneously. This eventuality cannot be avoided with the electromagnetic switchgear assembly disclosed in Herrmann inasmuch as the travel distance of the contact bridge carrier is necessarily restricted.

As disclosed in German Petty Patent (Gebrauchsmuster) No. 84 31 938 and in German Laid Open Application (Auslegeschrift) No. 11 97 535, an elastic coupling between a contact carrier and an armature is provided for adapting the movable magnet part to the fixed magnet part, the coupling spring being accordingly designed.

An object of the present invention is to provided an improved electromagnetic switchgear of the above-mentioned type.

Another, more particular, object of the present invention is to provide such a switchgear in which a closing connection between a pair of contact members is prevented in the event that another pair of contact members are welded to one another.

SUMMARY OF THE INVENTION

An electromagnetic switchgear in accordance with the present invention comprises a housing, a movable contact carrier shiftably mounted to the housing, two first circuit closing contacts, two second circuit closing contacts, an exciter coil fastened to the housing, a movable armature, and a connection element for elastically coupling the carrier and the movable armature to one another. The first circuit closing contacts include at least one first fixed contact mounted to the housing and at least one first movable contact mounted to the carrier. The first movable contact is engagable with the first fixed contact to form an electrical connection therewith. The second circuit closing contacts include at least one second fixed contact mounted to the housing and at least one second movable contact mounted to the carrier. The second movable contact is engagable with the second fixed contact to form an electrical connection therewith.

The movable armature is disposed in substantial juxtaposition to the exciter coil to cooperate therewith to break an engagement between the first fixed contact and the first movable contact and to subsequently form an engagement between the second fixed contact and the second movable contact upon a change in an energization state of the coil. The armature and coil further cooperate to break an engagement between the second fixed contact and the second movable contact and to subsequently form an engagement between the first fixed contact and the first movable contact upon a different change in an energization state of the exciter coil.

The connection element elastically coupling the carrier and the movable armature to one another enables at least limited relative motion between the carrier and the movable armature so that the formation of engagement between the first circuit closing contacts or between the second circuit closing contacts is prevented during a shifting of the armature upon a welding together of the second circuit closing contacts or the first circuit closing contacts, respectively.

Pursuant to further features of the present invention, the connection element includes a coupling spring disposed between the carrier and the armature, the coupling spring having a pretensioning force greater than a first total force required to form engagement between the first circuit closing contacts and also greater than a second total force required to form engagement between the second circuit closing contacts.

Pursuant to yet further features of the present invention, each contact has a stiffness adapted to the forces exerted by the coupling spring so that a deformation of any contact is precluded during motion of the armature. In addition, a sensor or motion monitor is mounted at least indirectly to the housing (e.g., to the armature in turn mounted to the housing) for detecting relative motion between the carrier and the armature and for generating an alert signal upon detection of such relative motion.

An electromagnetic switchgear in accordance with the present invention precludes a closing of a pair of contacts in the event that another pair of contacts are welded shut. This preventative results from the provision that the movable armature can continue to move during a switching operation without forming an engagement between a pair of open contacts.

An elastic connection in accordance with the invention can be realized by a predetermined fracture point or by a snap-in detent. Such alternative designs, however, are relatively expensive.

BRIEF DESCRIPTION OF THE DRAWING

The sole FIGURE the drawing is an isometric view of an electromagnetic switchgear in accordance with the invention, a major portion of the housing being broken away to enable depiction of the operating components.

DETAILED DESCRIPTION

As illustrated in the drawing, an electromagnetic switchgear comprises a non-switching stationary magnet part 1 with an exciter coil 2 both of which are fastened to a housing, portions of which housing are represented at 21 and 22. A movable magnet part or armature 3 is connected to a contact bridge carrier 4 via a latch or detent 5 and a bracket 6, as well as by a coupling spring 7, in accordance with the present invention. Spring 7 is braced on the one hand against bracket 6 and on the other hand against a projection 8 of contact bridge carrier 4.

Contact bridge carrier 4 is provided with a multiplicity of windows or cavities 9 which contain respective contact pressure springs 11 and inner portions of respective movable contact members 10 and 20 (only two being shown in the drawing for purposes of clarity). Movable contact members 10 and 20 are held in respective cavities 9 by respective contact pressure springs 11. Movable contact members 10 and 20 cooperate with respective fixed contact members 12 and 13 to form respective electrical connections therewith.

Schematically illustrated back pressure springs 14 are provided between portions 21 and 22 of the housing, on the one hand, and respective wings or flanges 23 and 24 of contact bridge carrier 4. Back pressure springs 14 cause armature 3 together with contact bridge carrier 4 to be urged away from exciter coil 2.

In the operating position illustrated in the drawing, upper movable contact member 10 is in engagement with upper fixed contact member 12, the associated contact pressure spring 11 being in a compressed state. Upon a subsequent energization of exciter coil 2, armature 3 is pulled against the force exerted by back pressure springs 14 toward non-switching magnet part 1 and exciter coil 2. In normal operation of the switchgear, the bridge of upper contact member 10 is arrested by an upper surface or edge of the associated cavity 9 and thereby lifts or shifts the contact member 10 away from fixed contact member 12 so that the switch connection formed by contact members 10 and 12 is opened. After this opening, lower contact member 20 engages the associated fixed contact member 13 and thereby closes an electrical connection therewith.

As set forth hereinabove, the opening of a pair of contact members, e.g., contact members 10 and 12, must occur prior to the closing of the other pair of contact members, i e., contact members 20 and 13. In the event that contact member 10 is welded to contact member 12, the bridge of contact member 10 is arrested again at the upper surface or edge of the associated cavity 9. However, contact members 10 and 12 are made so thick and stiff in relation to the compressibility of coupling spring 7 that further motion of contact bridge carrier 4 is prevented, the ensuing relative motion between armature 3 and carrier 4 being accommodated by coupling spring 7. More particularly, spring or springs 7 are compressed during continued motion of armature 3 so that a closing of fixed contact member 13 and movable contact member 20 does not occur. If, during continued motion of armature 3 the weld between contact members 10 and 12 is broken, spring 7 urges contact bridge carrier 4 towards armature 3 and exciter coil 2, thereby enabling engagement of contact members 13 and 20.

Differential movement between armature 3 and contact bridge carrier 4 is advantageously detected by a sensor or other motion monitor such as a microswitch 25. Microswitch 25 may be connected to a battery or other power source 26 for illuminating an alert light 27. Microswitch 25 may be mounted to either armature 3 or carrier 4 (armature 3 in the drawing). As an alternative to microswitch 25, a welded condition of a pair of associated contact members may be detected by the fact that an indicator plunger is neither in an "on" nor in an "off" position upon excitation of coil 2, but rather occupies an intermediate position.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. Electromagnetic switchgear comprising:

a housing;

a movable contact carrier shiftably mounted to said housing via a back pressure spring;

first circuit closing means including at least one first fixed contact mounted to said housing and at least one first movable contact mounted to said carrier, said first movable contact being engageable with said first fixed contact to form an electrical connection therewith;

second circuit closing means including at least one second fixed contact mounted to said housing and at least one second movable contact mounted to said carrier, said second movable contact being engageable with said second fixed contact to form an electrical connection therewith;

an exciter coil fastened to said housing;

an armature movably mounted to said housing in substantial juxtaposition to said coil to cooperate therewith to break an engagement between said first fixed contact and said first movable contact and to subsequently form an engagement between said second fixed contact and said second movable contact upon a change in an energization state of said coil and to break an engagement between said second fixed contact and said second movable contact and to subsequently form an engagement between said first fixed contact and said first movable contact upon a different change in an energization state of said coil; and connection means for elastically coupling said carrier and said armature to one another to enable at least limited relative motion between said carrier and said armature so that the formation of engagement between members of one of said circuit closing means is prevented during a shifting of said armature in response to a change in energization state of said coil upon a welding together of members of another of said circuit closing means, said connetion means including a coupling spring disposed between said carrier and said armature, said coupling spring having a pretensioning force greater than a first total force required to form engagement between members of said first circuit closing means and greater than a second total force requried to form engagement between members of said first circuit closing means and greater than a second total force required to form engagement between members of said second circuit closing means, at least one of said first total force and said second total force including a force exerted by said back pressure spring.

2. The switchgear recited in claim 1 wherein said connection means includes a coupling spring disposed between said carrier and said armature.

3. The switchgear recited in claim 2 wherein said coupling spring has a pretensioning force greater than a first total force required to form engagement between members of said first circuit closing means and greater than a second total force required to form engagement between members of said second circuit closing means.

4. The switchgear recited in claim 3 wherein each said contact has a stiffness adapted to forces exerted by said coupling spring so that a deformation of any said contact is precluded during motion of said armature.

5. The switchgear recited in claim 4, further comprising sensor means mounted at least indirectly to said housing for detecting relative motion between said carrier and said armature and for generating an alert signal upon detection of such relative motion.

6. The switchgear recited in claim 3, further comprising sensor mean mounted at least indirectly to said housing for detecting relative motion between said carrier and said armature and for generating an alert signal upon detection of such relative motion.

7. The switchgear recited in claim 2, further comprising sensor means mounted at least indirectly to said housing for detecting relative motion between said carrier and said armature and for generating an alert signal upon detection of such relative motion.

8. The switchgear recited in claim 1 wherein each said contact has a stiffness adapted to forces exerted by said coupling spring so that a deformation of any said contact is precluded during motion of said armature.

9. The switchgear recited in claim 1, further comprising sensor means mounted at least indirectly to said housing for detecting relative motion between said carrier and said armature and for generating an alert signal upon detection of such relative motion.

10. The switchgear recited in claim 1, further comprising sensor means mounted at least indirectly to said housing for detecting relative motion between said carrier and said armature and for generating an alert signal upon detection of such relative motion.

11. Electromagnetic switchgear comprising:

a housing;

a movable contact carrier shiftably mounted to said housing, first circuit closing means including at least one first fixed contact mounted to said housing and at least one first movable contact being engageable with said first fixed contact to form an electrical connection therewith;

second circuit closing means including at least one second fixed contact mounted to said housing and at least one second movable contact mounted to said carrier, said second movable contact being engageable with said second fixed contact to form an electrical connection therewith;

an exciter coil fastened to said housing;

an armature movably mounted to said housing in substantial juxtaposition to said coil to cooperate therewith to break an engagement between said first fixed contact and said first movable contact and to subsequently form an engagement between said second fixed contact and said second movable contact upon an energization of said coil and to break an engagement between said second fixed contact and said second movable contact and to subsequently form an engagement between said first fixed contact and said first movable contact upon a de-energization of said coil;

connection means for elastically coupling said carrier and said movable armature to one another to enable at least limited relative motion between said carrier and said armature so that the formation of engagement between members of said second circuit closing means is prevented during a shifting of said armature in response to an energization of said coil upon a welding together of members of said first circuit closing means, said connection means including a coupling spring disposed between said carrier and said armature, each said contact having a stiffness adapted to frce exerted by said coupling spring so that a deformation of any said contact is precluded during motion of said armature; and sensor means mounted at least indirectly to said housing for detecting relative motion between said carrier and said armature and for generating an alert signal upon detection of such relative motion.

* * * * *